US011503975B2

(12) United States Patent
Wang et al.

(10) Patent No.: US 11,503,975 B2
(45) Date of Patent: Nov. 22, 2022

(54) DRY-WET SEPARATION CLEANING FLOOR BRUSH

(71) Applicant: Shenzhen Shermon Technology Co., Limited, Shenzhen (CN)

(72) Inventors: Xiaofeng Wang, Shenzhen (CN); Shangliu Liu, Shenzhen (CN); Chaoliang Ma, Shenzhen (CN)

(73) Assignee: SHENZHEN SHERMON TECHNOLOGY CO., LIMITED, Shenzhen (CN)

( * ) Notice: Subject to any disclaimer, the term of this patent is extended or adjusted under 35 U.S.C. 154(b) by 341 days.

(21) Appl. No.: 16/831,864

(22) Filed: Mar. 27, 2020

(65) Prior Publication Data

US 2021/0298555 A1 Sep. 30, 2021

(30) Foreign Application Priority Data

Mar. 26, 2020 (JP) ..... JP2020-055351

(51) Int. Cl.

| | |
|---|---|
| ***A47L 11/40*** | (2006.01) |
| ***A47L 7/00*** | (2006.01) |
| ***A47L 11/282*** | (2006.01) |
| ***A47L 11/292*** | (2006.01) |

(52) U.S. Cl.

CPC ..... *A47L 11/4016* (2013.01); *A47L 7/0014* (2013.01); *A47L 7/0023* (2013.01); *A47L 11/282* (2013.01); *A47L 11/292* (2013.01); *A47L 11/4083* (2013.01); *A47L 2201/06* (2013.01)

(58) Field of Classification Search

CPC ..... A47L 11/40; A47L 11/4088; A47L 11/282

See application file for complete search history.

(56) References Cited

U.S. PATENT DOCUMENTS

| | | | | |
|---|---|---|---|---|
| 2002/0108210 | A1* | 8/2002 | Kaffenberger | A47L 9/0416 15/387 |
| 2014/0173847 | A1* | 6/2014 | Nguyen | A47L 11/34 15/322 |
| 2014/0345079 | A1* | 11/2014 | Johnson | A47L 11/4088 15/322 |
| 2015/0082579 | A1* | 3/2015 | Lin | A47L 1/02 15/320 |
| 2018/0199785 | A1* | 7/2018 | Farmer | A47L 9/22 |
| 2021/0030229 | A1* | 2/2021 | Jang | A47L 11/4013 |

* cited by examiner

*Primary Examiner* — Michael D Jennings

(57) ABSTRACT

The present disclosure provides a dry-wet separation cleaning floor brush. The dry-wet separation cleaning floor brush includes a housing, a stiff roller brush and a soft roller brush, wherein the housing is provided with a partition plate dividing the inner part of the housing into a first storage chamber and a second storage chamber which are disconnected to each other, wherein the stiff roller brush is partially contained in the first storage chamber and is movably connected to the housing, and the stiff roller brush partially protrudes the housing; and the soft roller brush is partially contained in the second storage chamber and movably connected to the housing, and the soft roller brush partially protrudes the housing.

20 Claims, 3 Drawing Sheets

DRY-WET SEPARATION CLEANING FLOOR BRUSH

BACKGROUND

1. Technical Field

The present invention relates to the technical field of cleaning robots, in particular to a dry-wet separation cleaning floor brush.

2. Description of Related Art

Some sweeping robots and vacuum cleaners now have three cleaning functions of sweeping, vacuuming and mopping simultaneously. The mopping function has high requirements for sweeping robots and vacuum cleaners. When performing mopping, the sweeping robot or vacuum cleaner first sprays the clean water from the water tank onto the ground, and then wipes the water on the ground with the duster cloth at the bottom of the sweeping robot or vacuum cleaner to clean the ground. Such cleaning method has the following disadvantages: 1. the duster cloth at the bottom of the sweeping robot and vacuum cleaner cannot be automatically cleaned, leading to poor cleaning effect; 2. the sweeping robot and vacuum cleaner cannot collect sewage, leading to poor cleaning effect; 3. some sweeping robots and vacuum cleaners are equipped with a box for collecting sewage, but the sewage is stored together with dust, which makes the box easily blocked.

DETAILED DESCRIPTION

In order to explain the technical scheme of the invention more clearly and completely, the present invention is further described below with reference to the drawings.

Figure 1:
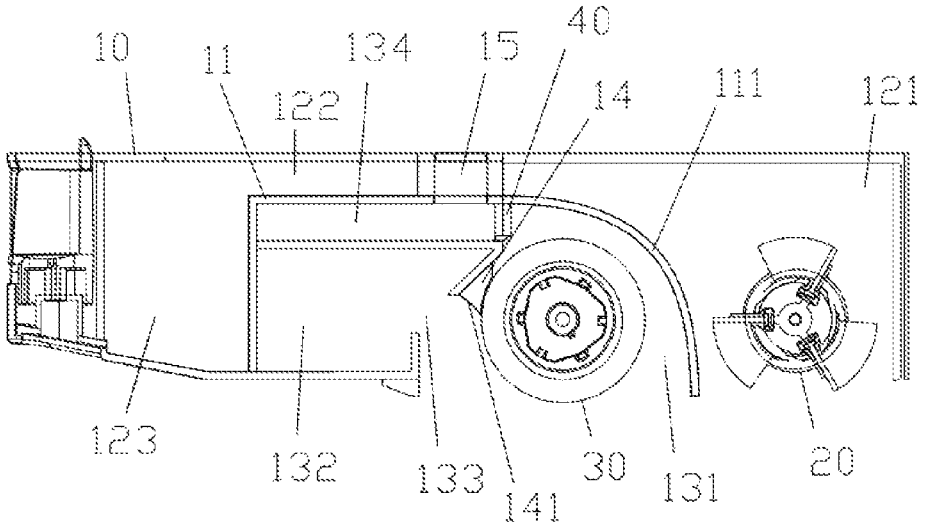
FIG. 1 is a perspective view of a dry-wet separation cleaning floor brush according to the present invention.
Figure 2:
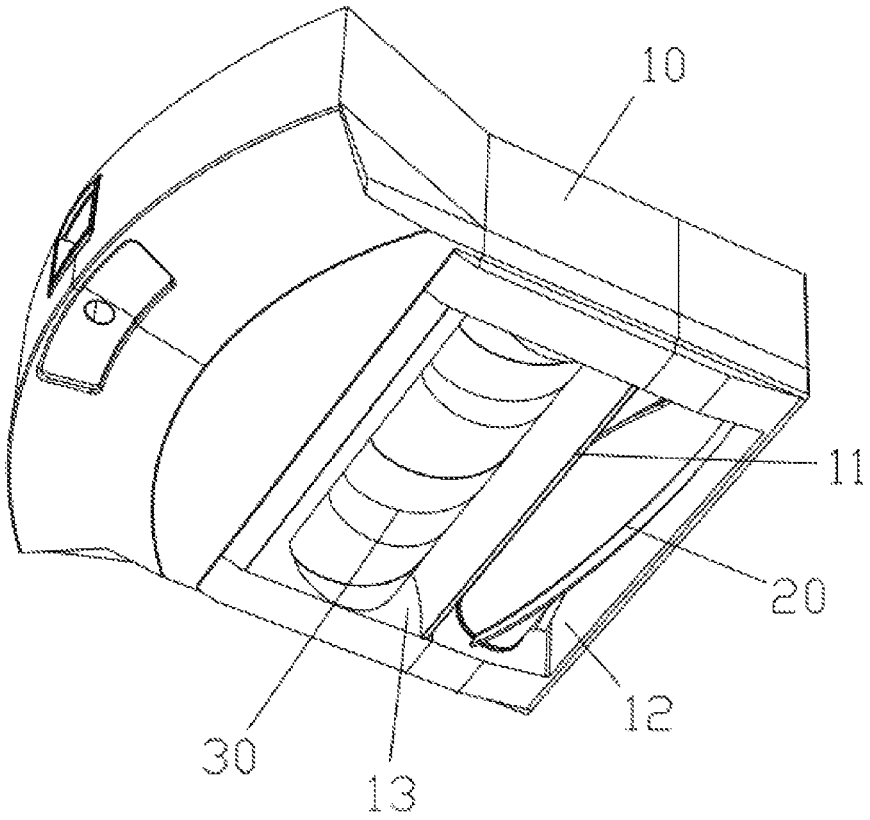
FIG. 2 is a stereogram of a dry-wet separation cleaning floor brush according to the present invention.
Figure 3:
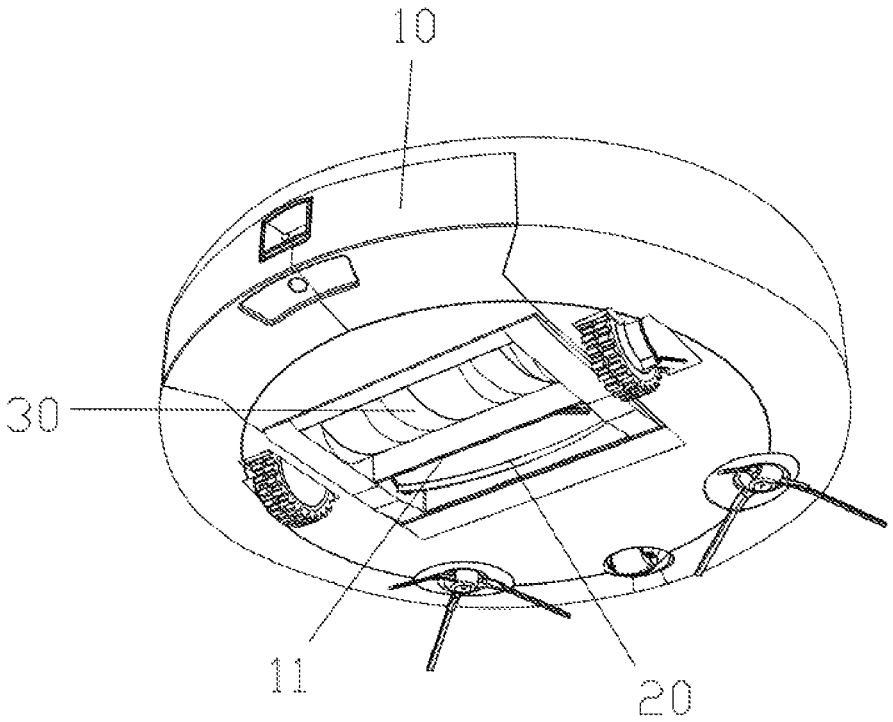
FIG. 3 is a schematic diagram of a dry-wet separation cleaning floor brush installed on an external sweeping robot according to the present invention.

Referring to FIG. 1-3, the present invention provides a dry-wet separation cleaning floor brush, the dry-wet separation cleaning floor brush includes a housing 10, a stiff roller brush 20 and a soft roller brush 30. The housing 10 is provided with a partition plate 11 dividing the inner part of the housing 10 into a first storage chamber 12 and a second storage chamber 13 which are disconnected to each other. The stiff roller brush 20 is partially contained in the first storage chamber 12 and is movably connected to the housing 10, and the stiff roller brush 20 partially protrudes the housing 10. The soft roller brush 30 is partially contained in the second storage chamber 13 and is movably connected to the housing 10, and the soft roller brush 30 partially protrudes the housing 10.

In this embodiment, the housing 10 is provided with a partition plate 11 dividing the inner part of the housing 10 into the first storage chamber 12 and the second storage chamber 13 which are disconnected to each other. The first storage chamber 12 is used for vacuuming and sweeping, and the second storage chamber 13 is used for mopping. The dry-wet separation cleaning floor brush can perform dry-wet separation cleaning work by the partition plate 11, so that vacuum cleaners or sweeping robots using the dry-wet separation cleaning floor brush can realize the dry-wet separation cleaning work.

Furthermore, the partition plate 11 is provided with a first curved portion 111 located between the stiff roller brush 20 and the soft roller brush 30. The first curved portion 111 wraps the soft roller brush 30.

In this embodiment, the first curved portion 111 bends and wraps the soft roller brush 30, and the curved arc of the first curved portion 111 facilitates the passage of dust and small volume of garbage.

Furthermore, the first storage chamber 12 is provided with a vacuum cavity 121, and the stiff roller brush 20 is partially contained in the vacuum cavity 121 and is movably connected to the housing 10.

In this embodiment, the stiff roller brush 20 is rotatable relative to the housing 10, and during operation, the stiff roller brush 20 is rotated clockwise to suck external dust and small volume of garbage into the vacuum chamber 121.

Furthermore, the first storage chamber 12 is further provided with a dust collection cavity 123 and a dust passage 122 through which the vacuum cavity 121 is connected with the dust collection cavity 123. The external dust is sucked into the vacuum cavity 121 by the rotation of the stiff roller brush 20, and the external dust is stored in the dust collection cavity 123 through the dust passage 122.

In this embodiment, the second storage chamber 13 is located between the vacuum cavity 121 and the dust collection cavity 123. During operation, the stiff roller brush 20 is rotated clockwise and external dust and small volume of garbage is sucked into the vacuum cavity 121. The external dust and small volume of garbage are subjected to the thrust generated by clockwise rotation of the stiff roller brush 20 after entering the vacuum cavity 121, and the thrust generated by clockwise rotation of the stiff roller brush 20 will carry external dust and small volume of garbage through the dust passage 122 into the dust collection cavity 123 for storage, so that the dry-wet separation cleaning floor brush has two cleaning functions of sweeping and vacuuming.

Furthermore, the second storage chamber 13 is provided with a decontamination cavity 131, and the soft roller brush 30 is partially contained in the decontamination cavity 131 and is movably connected to the housing 10.

In this embodiment, the soft roller brush 30 can rotate relative to the housing 10, and during operation, the soft roller brush 30 rotates to wipe the external floor for mopping, so as to clean the floor, thus enabling the dry-wet separation cleaning floor brush to have the cleaning function of mopping. The dry-wet separation cleaning floor brush has three cleaning functions of sweeping, vacuuming and mopping. The external vacuum cleaner or sweeping robot could have three cleaning functions of sweeping, vacuuming and mopping with this dry-wet separation cleaning floor brush. Compared with the current vacuum cleaners and sweeping robots, from which only the dust box could be dismantled, the dry-wet separation cleaning floor brush can be removed from the vacuum cleaner or sweeping robot as a whole, which is more convenient for cleaning and maintenance.

Furthermore, a wiping plate 14 matching the shape of the soft roller brush 30 is provided in the housing 10. The wiping plate 14 is contained in the decontamination cavity 131 and is fixedly connected to the housing 10. The wiping plate 14 abuts against the soft roller brush 30 and is partially immersed into the soft roller brush 30.

In this embodiment, the wiping plate 14 abuts against the soft roller brush 30 and is partially immersed into the soft roller brush 30. When the soft roller brush 30 rotates to perform mopping, the wiping plate 14 can scrape off the water from the soft roller brush 30 to clean the soft roller brush 30, so that the cleaning effect of the soft roller brush 30 is improved.

Furthermore, the second storage chamber 13 is further provided with a sewage cavity 132 and a sewage inlet 133 through the decontamination cavity 131 is connected with the sewage cavity 132. When the soft roller brush 30 rotates, the wiping plate 14 scrapes off the water from the soft roller brush 30, and the water from the soft roller brush 30 enters the sewage cavity 132 through the sewage inlet 133 for storage.

In this embodiment, the dry-wet separation cleaning floor brush is provided with the sewage cavity 132 for storing sewage and the dust collection cavity 123 for storing dust and small volume of garbage. The housing 10 is further provided with the partition plate 11 to separate the dust collection cavity 123 and the sewage cavity 132 from each other, so as to ensure that the sewage inlet 133 won't be blocked by dust and small volume of garbage.

Furthermore, the wiping plate 14 is provided with a second curved portion 141 at an end of the wiping plate 14 close to the sewage inlet 133, and the second curved portion 141 is recessed inward.

In this embodiment, when the soft roller brush 30 is rotated clockwise to work, the wiping plate 14 scraps off the water from the soft roller brush 30, and the second curved portion 141 recessed inward won't cover the sewage inlet 133. At this time, the water scraped off from the soft roller brush 30 is thrown forward by inertia, and the water scraped off from the soft roller brush 30 enters the sewage cavity 132 through the sewage inlet 133 for storage.

Furthermore, the second storage chamber 13 is further provided with a clean water cavity 134. The dry-wet separation cleaning floor brush is further provided with a one-way water outlet valve 40, which is connected with the clean water cavity 134, and the water stored in the clean water cavity 134 flows from the one-way water outlet valve 40 to the soft roller brush 30.

In this embodiment, the clean water cavity 134 is used to store clean water. When the soft roller brush 30 is rotated clockwise to work, the clean water stored in the clean water cavity 134 passes through the one-way water outlet valve 40 and flows onto the soft roller brush 30. The clean water moistens the soft roller brush 30 so that the soft roller brush 30 has a better cleaning effect of mopping. After the soft roller brush 30 wipes the floor, the clean water becomes sewage, and then the sewage is scraped off from the soft roller brush 30 by the wiping plate 14. The sewage is thrown forward due to inertia and then enters the sewage cavity 132 through the sewage inlet 133 for storage.

Furthermore, the housing 10 is further provided with a water inlet pipe 15. One end of the water inlet pipe 15 is connected with the clean water cavity 134, and the other end of the water inlet pipe 15 is flush with the housing 10.

In this embodiment, the water inlet pipe 15 runs through the dust passage 122. Clean water can be added to the clean water cavity 134 through the water inlet pipe 15.

Apparently, the present invention may have various other embodiments. Based on this embodiment, other embodiments obtained by those skilled in the art without any creative labor shall fall within the protection scope of the present invention.

What is claimed is:

1. A dry-wet separation cleaning floor brush comprising a housing, a stiff roller brush and a soft roller brush, wherein the housing is provided with a partition plate dividing the inner part of the housing into a first storage chamber and a second storage chamber which are disconnected to each other, wherein the stiff roller brush is partially contained in the first storage chamber and is movably connected to the housing, and the stiff roller brush partially protrudes the housing; and the soft roller brush is partially contained in the second storage chamber and is movably connected to the housing, and the soft roller brush partially protrudes the housing;

wherein the first storage chamber is provided with a vacuum cavity, and the stiff roller brush is partially contained in the vacuum cavity and is movably connected to the housing; and wherein the first storage chamber is further provided with a dust collection cavity and a dust passage through which the vacuum cavity is connected with the dust collection cavity, wherein external dust is sucked into the vacuum cavity by the rotation of the stiff roller brush, and external dust is stored in the dust collection cavity through the dust passage.

2. The dry-wet separation cleaning floor brush according to claim 1, wherein the partition plate is provided with a first curved portion located between the stiff roller brush and the soft roller brush, wherein the first curved portion wraps the soft roller brush.

3. The dry-wet separation cleaning floor brush according to claim 1, wherein the second storage chamber is provided with a decontamination cavity, wherein the soft roller brush is partially contained in the decontamination cavity and is movably connected to the housing.

4. The dry-wet separation cleaning floor brush according to claim 3, wherein a wiping plate matching the shape of the soft roller brush is provided in the housing, wherein the wiping plate is contained in the decontamination cavity and is fixedly connected to the housing, and wherein the wiping plate abuts against the soft roller brush and is partially immersed into the soft roller brush.

5. The dry-wet separation cleaning floor brush according to claim 4, wherein the second storage chamber is further provided with a sewage cavity and a sewage inlet through which the decontamination cavity is connected with the sewage cavity, and when the soft roller brush rotates, the wiping plate scrapes off water from the soft roller brush, and the water from the soft roller brush enters the sewage cavity through the sewage inlet for storage.

6. The dry-wet separation cleaning floor brush according to claim 5, wherein the wiping plate is provided with a second curved portion at an end of the wiping plate close to the sewage inlet, and the second curved portion is recessed inward.

7. The dry-wet separation cleaning floor brush according to claim 1, wherein the second storage chamber is further provided with a clean water cavity, and the dry-wet separation cleaning floor brush is further provided with a one-way water outlet valve, wherein the one-way water outlet valve is connected with the clean water cavity, and the water stored in the clean water cavity flows from the one-way water outlet valve to the soft roller brush.

8. The dry-wet separation cleaning floor brush according to claim 7, wherein the housing is further provided with a water inlet pipe, wherein one end of the water inlet pipe is connected with the clean water cavity, and the other end of the water inlet pipe is flush with the housing.

9. A dry-wet separation cleaning floor brush comprising a housing, a stiff roller brush and a soft roller brush, wherein the housing is provided with a partition plate dividing the inner part of the housing into a first storage chamber and a second storage chamber which are disconnected to each other, wherein the stiff roller brush is partially contained in the first storage chamber and is movably connected to the housing, and the stiff roller brush partially protrudes the housing; and the soft roller brush is partially contained in the second storage chamber and is movably connected to the housing, and the soft roller brush partially protrudes the housing;

wherein the second storage chamber is provided with a decontamination cavity, and the soft roller brush is partially contained in the decontamination cavity and is movably connected to the housing; and wherein a wiping plate matching the shape of the soft roller brush is provided in the housing, wherein the wiping plate is contained in the decontamination cavity and is fixedly connected to the housing, and wherein the wiping plate abuts against the soft roller brush and is partially immersed into the soft roller brush.

10. The dry-wet separation cleaning floor brush according to claim 1, wherein the partition plate is provided with a first curved portion located between the stiff roller brush and the soft roller brush, wherein the first curved portion wraps the soft roller brush.

11. The dry-wet separation cleaning floor brush according to claim 9, wherein the first storage chamber is provided with a vacuum cavity, wherein the stiff roller brush is partially contained in the vacuum cavity and is movably connected to the housing.

12. The dry-wet separation cleaning floor brush according to claim 9, wherein the second storage chamber is further provided with a sewage cavity and a sewage inlet through which the decontamination cavity is connected with the sewage cavity, and when the soft roller brush rotates, the wiping plate scrapes off water from the soft roller brush, and the water from the soft roller brush enters the sewage cavity through the sewage inlet for storage.

13. The dry-wet separation cleaning floor brush according to claim 12, wherein the wiping plate is provided with a second curved portion at an end of the wiping plate close to the sewage inlet, and the second curved portion is recessed inward.

14. The dry-wet separation cleaning floor brush according to claim 9, wherein the second storage chamber is further provided with a clean water cavity, and the dry-wet separation cleaning floor brush is further provided with a one-way water outlet valve, wherein the one-way water outlet valve is connected with the clean water cavity, and the water stored in the clean water cavity flows from the one-way water outlet valve to the soft roller brush.

15. The dry-wet separation cleaning floor brush according to claim 14, wherein the housing is further provided with a water inlet pipe, wherein one end of the water inlet pipe is connected with the clean water cavity, and the other end of the water inlet pipe is flush with the housing.

16. A dry-wet separation cleaning floor brush comprising a housing, a stiff roller brush and a soft roller brush, wherein the housing is provided with a partition plate dividing the inner part of the housing into a first storage chamber and a second storage chamber which are disconnected to each other, wherein the stiff roller brush is partially contained in the first storage chamber and is movably connected to the housing, and the stiff roller brush partially protrudes the housing; and the soft roller brush is partially contained in the second storage chamber and is movably connected to the housing, and the soft roller brush partially protrudes the housing; and wherein the second storage chamber is further provided with a clean water cavity, and the dry-wet separation cleaning floor brush is further provided with a one-way water outlet valve, wherein the one-way water outlet valve is connected with the clean water cavity, and the water stored in the clean water cavity flows from the one-way water outlet valve to the soft roller brush.

17. The dry-wet separation cleaning floor brush according to claim 16, wherein the partition plate is provided with a first curved portion located between the stiff roller brush and the soft roller brush, wherein the first curved portion wraps the soft roller brush.

18. The dry-wet separation cleaning floor brush according to claim 16, wherein the first storage chamber is provided with a vacuum cavity, wherein the stiff roller brush is partially contained in the vacuum cavity and is movably connected to the housing.

19. The dry-wet separation cleaning floor brush according to claim 16, wherein the second storage chamber is provided with a decontamination cavity, wherein the soft roller brush is partially contained in the decontamination cavity and is movably connected to the housing.

20. The dry-wet separation cleaning floor brush according to claim 16, wherein the housing is further provided with a water inlet pipe, wherein one end of the water inlet pipe is connected with the clean water cavity, and the other end of the water inlet pipe is flush with the housing.

* * * * *